United States Patent [19]

Thrasher et al.

[11] Patent Number: 4,993,938

[45] Date of Patent: Feb. 19, 1991

[54] CONTINUOUSLY-VARIABLE RATE PULSE COMBUSTION APPARATUS

[75] Inventors: William H. Thrasher, North Royalton; Gregory J. Wells, Cleveland, both of Ohio

[73] Assignee: Gas Research, Inc., Chicago, Ill.

[21] Appl. No.: 410,542

[22] Filed: Sep. 21, 1989

[51] Int. Cl.[5] ..... F23C 11/04

[52] U.S. Cl. ..... 431/1

[58] Field of Search ..... 431/1

[56] References Cited

U.S. PATENT DOCUMENTS 4,639,208 1/1987 Inui et al. .
4,708,635 11/1987 Vishwanath .
4,752,209 6/1988 Vishwanath et al. .
4,840,558 6/1989 Saito et al. ..... 431/1

*Primary Examiner*—Carroll B. Dority
*Attorney, Agent, or Firm*—Mason, Fenwick & Lawrence

[57] ABSTRACT

A continuously-variable rate pulse combustion apparatus comprising a main burner, a primary burner operably connected to the main burner, main and primary fuel supply lines including valves for self-feeding a combustible gaseous mixture to the main and primary burners, respectively, main and primary air supply lines including valves for providing one-way flow of air to the main and primary burners, a combustion chamber for pulse combustion of the combustible gaseous mixture to provide combustion gases, and an exhaust mechanism for self-exhausting the combustion gases from the combustion chamber. An inlet air decoupler is provided for acoustically decoupling the main and primary air supply lines. The inlet air decoupler has a primary section in fluid communication with the primary air supply line and a main section in fluid communication with the main air supply line, a main inlet air tube for supplying combustion air to the main section, a primary inlet air tube for supplying combustion air to the primary section, and a main valve mechanism for controlling air flow into the main inlet air tube.

8 Claims, 1 Drawing Sheet

CONTINUOUSLY-VARIABLE RATE PULSE COMBUSTION APPARATUS

BACKGROUND OF THE INVENTION

The present invention is directed to pulse combustion heating apparatus, and more particularly to a pulse combustion heating apparatus having a continuously-variable rate.

A multiple rate pulse combustion burner of the Helmholtz-type is described in U.S. Pat. No. 4,708,635 (Vishwanath), incorporated by reference herein. In this apparatus, a primary burner with a low input rate and a main burner having a higher input rate are combined to provide an integrated combustion process. Vishwanath describes the size ratio between the main and primary burners and states that up to a 100% turn-down (modulation of input rate) of the main burner can be achieved However, Vishwanath does not provide for the control of air flow into either the primary or the main burner, so that the air flow control means is fixed for any given application and is related to the pressure oscillations within the combustor system and the design of the two air flapper valves. Furthermore, in a high-efficiency combination heating/cooling system, the heating portion of the system must possess a high steady-state efficiency and be capable of operating with an input rate having a wide range. Consequently, a pulse combustion burner of the type disclosed by Vishwanath would not be suitable for such a high-efficiency combination heating/cooling system.

It is the solution of this and other problems to which the present invention is directed.

SUMMARY OF THE INVENTION

It is, therefore, a primary object of the invention to provide pulse combustion apparatus capable of operating with a variable input rate.

This and other objects of the invention are achieved by provision of a continuously-variable rate pulse combustion apparatus comprising a main burner, a primary burner operably connected to the main burner, main and primary fuel supply lines including valves for self-feeding a combustible gaseous mixture to the main and primary burners respectively, main and primary air supply lines including valves for providing one-way flow of air to the main and primary burners, a combustion chamber for pulse combustion of the combustible gaseous mixture to provide combustion gases, and an exhaust mechanism for self-exhausting the combustion gases from the combustion chamber. An inlet air decoupler is provided for acoustically decoupling the main and primary air supply lines. The inlet air decoupler has a primary section in fluid communication with the primary air supply line and a main section in fluid communication with the main air supply line, a main inlet air tube for supplying combustion air to the main section, a primary inlet air tube for supplying combustion air to the primary section, and a main valve mechanism for controlling air flow into the main inlet air tube.

In one aspect of the invention, the primary air inlet tube is also provided with a primary valve mechanism for controlling air flow therein.

In another aspect of the invention, the main and primary valve mechanisms comprise butterfly valves.

In still another aspect of the invention, the inlet air decoupler comprises a decoupling box including a single wall separating the main section from the primary section.

DETAILED DESCRIPTION OF THE PREFERRED EMBODIMENTS

Figure 1A:
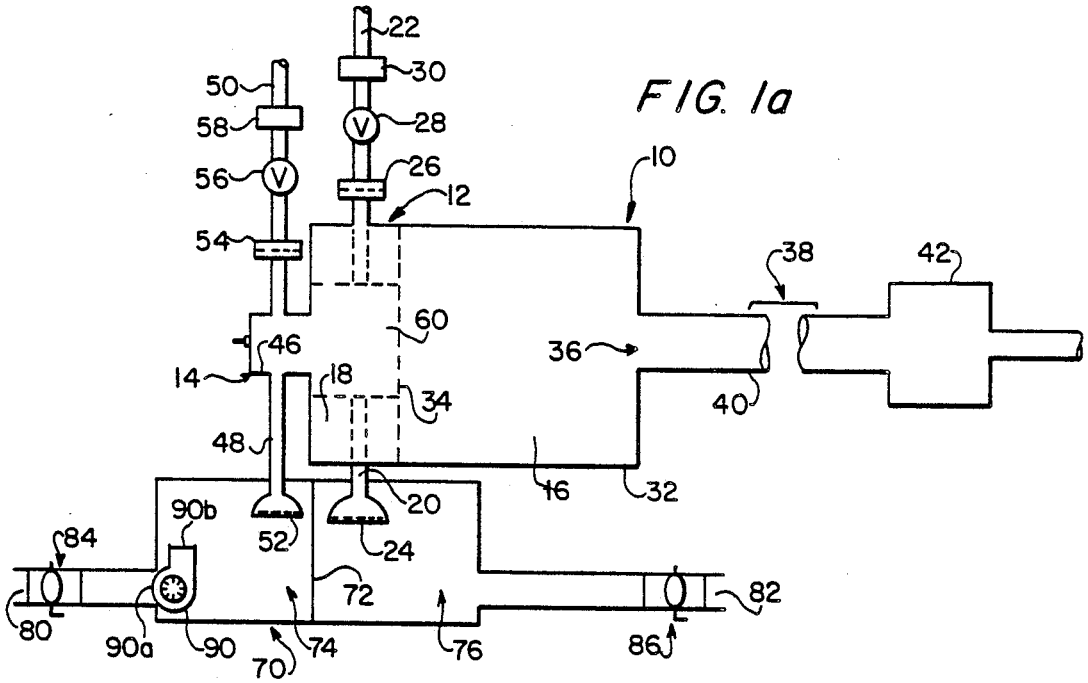
FIG. 1*a* is a diagrammatic, elevational view of a continuously-variable rate pulse combustion apparatus in accordance with the invention.

Referring to FIG. 1*a*, there is shown a pulse combustion apparatus 10 in accordance with the invention including a primary burner 12 and a main burner 14 similar to those described in the Vishwanath patent. Main burner 14 includes a chamber 16 having a mixer head portion 18 adjacent its forward end. Mixer head 18 is connected to an air supply line 20 and a fuel supply line 22. Supply lines 20 and 22 respectively include flapper valves 24 and 26 which allow one-way flow and self-feeding of a combustible gaseous mixture to mixer head 18 in a known manner. Fuel supply line 22 also includes a valve 28 for regulating the flow of fuel to mixer head 18 and operating main burner 14 at variable input rates over a predetermined turned-down ratio. A variable gas flow control 30 can also be installed on fuel supply line 22.

Main burner 14 also includes a combustion chamber 32 positioned downstream of mixer head 18. Combustion chamber 32 includes an inlet opening 34 for receiving combustion gases from mixer head 18 and an outlet opening 36 for passing the combustion gases to an exhaust system 38.

Exhaust system 38 includes a tailpipe or exhaust pipe 40 for receiving the combustion gases from combustion chamber 32 and conveys them to a gas decoupler 42.

Primary burner 12 includes a mixer head 46 connected to an air supply line 48 and a fuel supply line 50. Supply lines 48 and 50 are respectively provided with flapper valves 52 and 54 to provide self-feeding of a combustible gaseous mixture to mixer head 48. A valve 56 is provided in fuel supply line 50 for independent control of the fuel supply and regulation thereof over the turn-down ratio of primary burner 12. Also, a variable gas flow control 58 can be installed on fuel supply line 50.

Primary burner 12 also includes a combustion chamber 60 corresponding to combustion chamber 16 of main burner 14. Mixer head 46 communicates with chamber 16 and mixer head 18.

An inlet air decoupler box 70 of conventional design is provided around air flapper valves 26 and 52 to acoustically decouple the system and provide sound reduction in a well-known manner. As shown in FIG. 1*a*, air box 70 is a single, relatively large, box enclosing both air flapper valves 24 and 52, with one common wall 72 to isolate the pressure oscillations from each of the air flapper valves. However, two separate air boxes can be used if the geometry of the combustion system requires it.

Figure 1B:
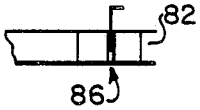
FIG. 1*b* is a partial diagrammatic, elevational view of an inlet tube for an inlet air decoupler box in accordance with the invention, incorporating a gate valve.

Wall 72 defines primary and main sections 74 and 76 within box 70 enclosing flapper valves 52 and 24, respectively. Primary and main sections 74 and 76 are provided respectively with inlet air tubes 80 and 82 through which combustion air passes. Inlet air tubes 80 and 82 are sized such that the calculated Helmholtz frequency of the box/tube combination is less than 60% of the natural operating frequency of the unit. Air inlet tubes 80 and 82 are in turn provided respectively with valve mechanisms 84 and 86 at the ends thereof to control air flow to the primary and main sections 74 and 76 of box 70, respectively, and to primary and main mixer heads 46 and 18, respectively. Alternately, it is possible to use only a single-valve mechanism 86 at the end of an inlet tube 82 communicating with main section 76. In a preferred embodiment, valve mechanisms 84 and 86 comprise butterfly valves. However, any equivalent valve mechanism, such as a gate mechanism can also be used, as shown in FIG 1*b*. A starting air blower 90, for example, a small squirrel cage blower, can also be installed in primary section 74.

Normally, but not necessarily, blower 90 is positioned inside primary section 74 of air box 70 as shown in FIG. 1*a*. In this location, the inlet 90*a* of blower 90 is positioned where primary air inlet tube 80 joins air box 70. The outlet 90*b* of blower 90 is then directed directly into the volume inside primary section 74. Alternatively, blower 90 can be positioned outside box 70 either at the end of primary section inlet air tube 80 (not shown) or directly on the outside of box 70 (also not shown) The preferred location is inside box 70 as shown in FIG. 1*a* because some sound attenuation is effected by blower 90 and sealing of the system is easier.

When valve mechanisms 84 and 86 are open, there is little restriction to air flow. When they are closed, there is a controlled pre-set air flow around the valve plates (not shown) which provides a small amount of additional air for improved burner operation. The position of the butterfly valves of mechanisms 84 and 86 during operation of the burner are dependent on the quantity of gas flowing to the combustor. Valve mechanisms 84 and 86 can be operated manually or automatically using conventional technology operators (e.g., electric, electronic and pneumatic). Also, valve mechanisms 84 and 86, such as butterfly valves, can be fully opened, fully closed or at any position in-between.

Air inlet tubes 80 and 82 also serve to reduce the sound levels produced by apparatus 10. The use of shorter, wider diameter tubes would result in the emanation of relatively more sound from apparatus 10 than the use of longer, smaller diameter tubes.

When a combustor of the type described in the Vishwanath patent operates at its normal full input rate (primary plus main), full air flow to both of air flapper valves 24 and 52 is required. Reducing the gas flow to the main burner will reduce the main burner's input rate and lever of $CO_2$ in the products of combustion. The reduced $CO_2$ level, caused by increased excess air flow through the combustor, results in lower heat transfer efficiency. Controlling the air flow to the burner through valve mechanisms 84 and 86 in air box 70 maintains optimum excess air levels for proper burner operation and maximum efficiency at all input rates.

In a conventional combustor as described by Vishwanath, the magnitude of the pressure oscillations in the system is reduced as the main input rate is reduced, resulting in lower heat transfer efficiency. The addition of the air box 70 incorporating air inlet tubes 80 and 82 and valve mechanisms 84 and 86 controls the air at optimum levels; maintains optimum pressure oscillations and maximum efficiency; and maintains satisfactory combustion at larger turn-down ratios. Maintenance of satisfactory combustion at larger turn-down ratios in turn results in a greater overall turn-down ratio for any given burner system.

In operation, the apparatus 10 is normally started at the primary input rate using primary mixer head 46 and its air and gas flow systems. Air and gas do not flow to the main mixer head 18 during starting and operation of primary burner 12 except for the small, controlled amount of air that flows through valve mechanism 86. Gas flow to the primary and main mixer heads 46 and 18 is controlled by gas valves 56 and 28. Air flow to primary and main mixer heads 46 and 18 is controlled by valve mechanisms 84 and 86, respectively, which can be operated manually or automatically.

Primary burner 12 functions to stabilize and start main burner 14. Both mixer heads 18 and 46 function during normal full input rate operation. To switch from reduced to full input rate, the gas flow to main mixer head 18 is turned on and valve mechanism 86 controlling air flow to main air valve 24 is opened. Reducing the rate from full to reduced is accomplished by turning off the gas flow and closing the air flow control valve mechanism 86. Rate switching is smoothly and reliably accomplished in this manner.

Any pulse combustion air flapper valve system such as valves 24 and 52 has some blow-by during normal operation. This occurs prior to complete closure of the valve system during the positive pressure phase of the cycle. The amount of this blow-by increases as the flapper spacing is increased relative to the input rate of the burner. Similarly, decreasing the input rate with constant flapper spacing will result in increased blow-by at the reduced rates. Air flow control devices 84 and 86 provided in air inlet tubes 80 and 82 of air box 70 increase the relative pressure inside primary and main sections 74 and 76 of air box 70 during the positive pressure phase of the cycle, thus also decreasing blow-by while optimizing operational stability and efficiency.

Figure 2:
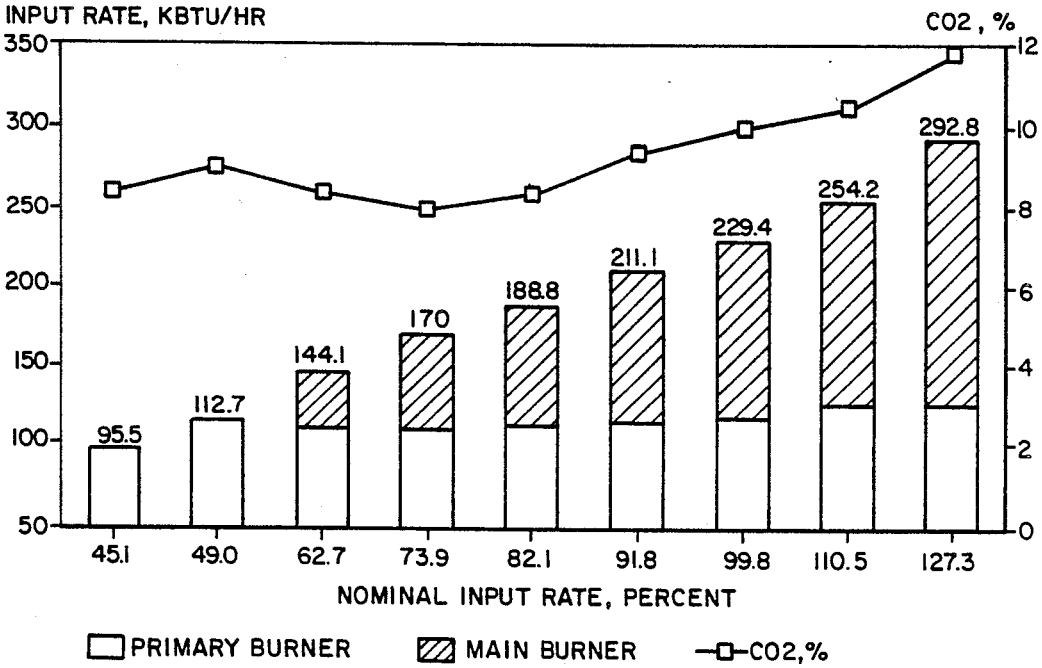
FIG. 2 is a graph showing the variation of input rate with nominal input for an apparatus in accordance with the invention

A pulse combustion heating apparatus built in accordance with the Vishwanath patent, and having a primary input rate of 115 kBtu/hr was provided with an air box in accordance with the invention Each section of the air box was provided with a 24" long section of 1½" PVC tubing attached thereto, and the air inlet tube to the main section was provided with a conventional butterfly valve at the end thereof. A single tailpipe, exhaust decoupler and a secondary heat exchanger were used to complete the heat transfer components of the combustor. The secondary heat exchanger comprises a three-row/43-tube aluminum finned copper tube positioned downstream of the exhaust decoupler. A 2½" diameter, 8½' long tail pipe was used. Also, heat transfer fins were attached to the main mixer head, combustion chamber and initial tailpipe section to increase efficiency and reduce surface temperature. The results of tests undertaken with this unit are set forth in Tables I, II and III, and FIG. 2.

As shown in Table I, unit operation was first evaluated by making measurements at the normal (100%) and the turndown (50%) input rate. A steady-state efficiency of 91.9% was obtained at 100% rate with a flue temperature of 138° F. and 9.2% $CO_2$. At 50% rate, the efficiency increased to 97.3% with a flue temperature of 92° F. and 8.7% $CO_2$. The efficiency is believed to have increased significantly at the lower rate because the excess air was controlled by the butterfly valve on the air inlet tube to the main section of the air box. Combustion quality measurements indicated 0.001% CO air-free at both input rates.

Fuel flow rate to the burner was determined by the use of a wet test gas meter. The flow rate of gas was then corrected to standard conditions and multiplied by the heating value of the gas to obtain the fuel input rate. The heating value was determined with a continuously recording Cutler-Hammer calorimeter. Temperatures were determined through the use of Type T and Type J thermocouplers attached to an electronic digital temperature display device. The concentrations of $CO_2$ and CO in the flue products were measured using a "Lira" model non-dispersive infra-red analyzer made by Mine Safety Appliance Company. Static pressure was measured using a liquid filled manometer.

TABLE I

Pulse Heating Section Operational Data

| Performance Parameter | 100% Rate | 50% Rate |
|---|---|---|
| Fuel Input Rate, Btu/hr | 229,600 | 115,600 |
| $CO_2$, % | 9.2 | 8.7 |
| CO, % (Air-Free) | 0.001 | 0.001 |
| Temperatures: | | |
| Combustion Chamber Outlet, °F. | 1925 | 1630 |
| Exhaust Decoupler Inlet, °F. | 1304 | 846 |
| Secondary Heat Exchanger, Top Manifold, °F. | 772 | 407 |
| Vent Outlet, °F. | 138 | 92 |
| Air Rise, °F. | 51 | 26 |
| Static Pressure, in W.C. | 0.36 | 0.36 |
| Condensate, lbs/hr | 6.9 | 8.1 |
| Efficiency (Steady-State), % | 91.9 | 97.3 |

Sound pressure levels were taken using a commercially available Bruel & Kjaer Model #2209 sound level meter, with the pulse heating section in a roof top unit cabinet operated at 100% and 50% input rates, shown in Table II. These data were taken with the air box lined with ½" foil-faced foam insulation and no outer cabinet panel over the vestibule area of the unit. The unit operated at 11 dBA above ambient at 100% input rate, and 6 dBA above ambient at 50% input rate, with the circulating air blower on. The use of shorter, wider diameter tubes would result in the emanation of more sound.

TABLE II

Pulse Heating Section Sound Pressure Levels

| Performance Parameter | 100% Rate | 50% Rate |
|---|---|---|
| Fuel Input Rate, Btu/hr | 228,400 | 117,400 |
| Sound Pressure Level* | | |
| Ambient | 65 dBA | 65 dBA |

TABLE II-continued

Pulse Heating Section Sound Pressure Levels

| Performance Parameter | 100% Rate | 50% Rate |
|---|---|---|
| Purge Blower Only | 65 dBA | 65 dBA |
| Combustor On/Circulating Air Blower Off | 76 dBA | 70 dBA |
| Combustor On/Circulating Air Blower On | 76 dBA | 71 dBA |

*Measured 3' from air box lines with ½" foil-faced foam. no outer cabinet panel over vestibule area of unit.

It was assumed that if the tested apparatus could operate satisfactorily at both the 50% (115 kBtu/hr) and 100% (230 kBtu/hr) input rates, as shown in Table I, it should also be able to operate at rates in-between. Initial test data indicated that it was possible to reduce the input rate to 72% of nominal input by reducing the gas pressure and slightly varying the main air flapper spacing. Lower input rates were obtained with an additional orifice in the main gas line to reduce gas flow. Satisfactory combustion and operation were obtained at these reduced input rates.

A set of test runs was taken with the input rate varied in approximately 10% intervals between 50% and 100% of rated input. Test runs, the results of which are shown in Table III and FIG. 2 were also taken at input rates above and below that range. Satisfactory combustion was obtained at all tested input rates between 49% and 127.3% of nominal input. Only one intermediate main burner butterfly valve setting, between fully opened and fully closed, was required over this input range. These results indicate that a step-acting variable rate pulse combustor in accordance with the invention can operate satisfactorily with a three-position operator on the butterfly valve mechanism. The input rate was reduced even further with the addition of the butterfly valve on the air inlet tube to the primary section of the air box. The unit operated satisfactorily, and with good combustion, at 41.5% of nominal input with this modification.

TABLE III

Pulse Heating Section Variable Rate Data

| | Primary Burner | | Main Burner | | | | | |
|---|---|---|---|---|---|---|---|---|
| Rate, kBtu/hr | Butterfly* Pos. | Rate, kBtu/hr | Manifold Pres. W.C. | Butterfly* Pos. | Total Rate kBtu/hr | Rate, % Nom. | $CO_2$ % | CO, % A/F |
| 124.0 | N/A | 168.8 | 8.0 | 0° | 292.8 | 127.3 | 11.8 | 0.030 |
| 123.8 | N/A | 130.4 | 4.9 | 0° | 254.2 | 110.5 | 10.5 | 0.001 |
| 115.4 | N/A | 114.0 | 2.8 | 0° | 229.4 | 99.8 | 10.0 | 0.001 |
| 112.5 | N/A | 98.6 | 1.7 | 0° | 211.1 | 91.8 | 9.4 | 0.001 |
| 111.1 | N/A | 77.7 | 0.2 | 0° | 188.8 | 82.1 | 8.4 | 0.001 |
| 108.1 | N/A | 61.9 | −0.4 | 0° | 170.0 | 73.9 | 8.0 | 0.001 |
| 108.7 | N/A | 35.4 | −2.5** | 60° | 144.1 | 62.7 | 8.4 | 0.001 |
| 112.7 | N/A | 0 | 0 | 90° | 112.7 | 49.0 | 9.0 | 0.001 |
| 95.5 | 60° | 0 | 0 | 90° | 95.5 | 41.5 | 8.4 | 0.003 |

*0° = fully open; 90° = fully closed.
**Adjusted variable gas orifice located upstream of main gas regulator.

The American National Standard for gas-fired central furnaces (except direct vent central furnaces) ANSI Z21.47-1987, with addenda Z21.47*a*-1988, specifies several tests for combustion quality and burner-operating characteristics The operation of the pulse-heating section was compared against the applicable requirements The data collected for Table III and also other test data indicated that combustion quality was good at the specified reduced test pressure and also at increased rate. The fact that the input rate could be increased to 127.3% of normal full input attests to the versatility of the apparatus in accordance with the invention. Burner ignition and operating characteristics were also satisfactory when the unit was fired with 1400 butane-air fuel gas.

Thus, it will be seen that the present invention provides a unique method for accomplishing continuously-variable rate operation of a pulse combustion apparatus. While a preferred embodiment of the invention has been disclosed, it should be understood that the spirit and scope of the invention are to be limited solely by the appended claims since numerous modifications of the disclosed embodiment will undoubtedly occur to those of skill in the art:

What is claimed is:

1. Continuously-variable rate pulse combustion apparatus comprising:

a main burner;

a primary burner operably connected to said main burner;

main fuel supply means for self-feeding a combustible gaseous mixture to said main burner;

primary fuel supply means for self-feeding a combustible gaseous mixture to said primary burner;

main air supply means for providing one-way flow of air to said main burner;

primary air supply means for providing one-way flow of air to said primary burner;

combustion chamber means for pulse combustion of the combustible gaseous mixture to provide combustion gases;

exhaust means for self-exhausting the combustion gases from said combustion chamber;

inlet air decoupling means for acoustically decoupling said main and primary air supply means, said inlet air decoupling means having a primary section surrounding at least a portion of said primary air supply means and a main section surrounding at least a portion of said main air supply means;

main inlet air means for supplying combustion air to said main section of said inlet air decoupling means;

primary inlet air means for supplying combustion air to said primary section of said inlet air decoupling means; and main valve means for controlling air flow into said main inlet air means.

2. The apparatus of claim 1, further comprising primary valve means for controlling air flow into said primary inlet air means.

3. The apparatus of claim 1, said main valve means comprising a butterfly valve.

4. The apparatus of claim 2, said main and primary valve means each comprising a butterfly valve.

5. The apparatus of claim 1, said main valve means comprising a gate valve.

6. The apparatus of claim 2, said main and primary valve means each comprising a gate valve.

7. The apparatus of claim 1, said inlet air decoupling means comprising a decoupling box including a single wall separating said main section from said primary section.

8. The apparatus of claim 1, further comprising a starting air blower installed in said primary section of said inlet air decoupling means.

* * * * *